US006182738B1

(12) United States Patent
Chen

(10) Patent No.: US 6,182,738 B1
(45) Date of Patent: Feb. 6, 2001

(54) SHOWER SCREEN

(76) Inventor: Chang Than Chen, 12F, No. 426, Ming Chuan 2nd Road, Chien Chen Chu, Kaohsiung (TW)

( * ) Notice: Under 35 U.S.C. 154(b), the term of this patent shall be extended for 0 days.

(21) Appl. No.: 09/376,413

(22) Filed: Aug. 18, 1999

(51) Int. Cl.[7] ..... E05D 15/26

(52) U.S. Cl. ..... 160/199; 160/206; 4/558; 4/608

(58) Field of Search ..... 160/199, 206, 160/84.06, DIG. 6; 16/90; 4/557, 558, 608, 610, 607

(56) References Cited

U.S. PATENT DOCUMENTS 2,699,827 * 1/1955 Carson ..... 160/84.06
2,885,000 * 5/1959 Merrill ..... 160/199
2,897,515 * 5/1959 Collins ..... 160/84.06
2,929,115 * 3/1960 Beckstrom .
3,054,118 * 9/1962 Bullock .
3,062,279 * 11/1962 Kochanowski ..... 160/199
3,418,666 * 12/1968 Rockey ..... 160/84.06
3,994,330 * 11/1976 Laby ..... 160/199
4,089,135 * 5/1978 Beny et al. .
4,228,560 * 10/1980 Baus .
4,258,443 * 3/1981 Baus .
4,404,770 * 9/1983 Markus .
5,690,157 * 11/1997 Chen ..... 160/199
5,822,810 10/1998 Chen ..... 4/610

* cited by examiner

*Primary Examiner*—Blair M. Johnson
(74) *Attorney, Agent, or Firm*—Charles E. Baxley

(57) ABSTRACT

A shower screen includes a guide rod and a guide bar secured between the top and the bottom portions of the posts. A screen member has an upper portion slidably secured to the guide rod and has two sides secured to two beams. The guide bar includes a wall extended upward from a base. The beams each has a retaining member secured to the bottom for slidably engaging with the wall of the guide bar and for preventing the screen member from being disengaged from the guide bar. The base includes an upper tapered surface for guiding water into a bath tub.

12 Claims, 2 Drawing Sheets

SHOWER SCREEN

BACKGROUND OF THE INVENTION

1. Field of the Invention

The present invention relates to a screen, and more particularly to a shower screen.

2. Description of the Prior Art

Typical shower curtains comprise a sheet of water proof cloth material having an upper portion slidably engaged on a top rail. The cloth material may be unfolded to prevent water from spilling when showering. However, the curtain may not suitably prevent water from spilling.

In order to solve such problems, the applicant has developed an improved shower screen which has been issued as U.S. Pat. No. 5,822,810 to Chen. However, the bottom portion of the shower screen is not secured to the lower bar and may be easily separated from the bar, such that the water may also split out through the gap formed between the lower portion of the shower screen and the bar.

The present invention has arisen to mitigate and/or obviate the afore-described disadvantages of the conventional shower curtains.

SUMMARY OF THE INVENTION

The primary objective of the present invention is to provide a shower screen for preventing water from spilling and for stably securing the bottom portion of the shower screen to a lower guide bar.

In accordance with one aspect of the invention, there is provided a shower screen comprising a pair of vertical posts each including a longitudinal channel formed therein and each including a bottom portion, a guide rod secured on top of the posts, a screen member including an upper portion slidably secured to the guide rod for allowing the screen member to be folded and unfolded, the screen member including two side portions, a beam secured to each of the side portions of the screen member and each including a rib for engaging with the channel of the post for preventing spilling, a guide bar including two ends secured to the bottom portions of the posts for forming a bottom block and guide member, and means for slidably securing the beams to the guide bar and to guide the beams to slide along the guide bar.

The beams each includes a notch formed therein for engaging with the guide bar and for preventing the beams from moving beyond the guide bar. The guide bar includes a base and a wall extended upward from the base, the wall includes an outer surface. The beams each includes a bottom portion, the slidably securing means includes two retaining members secured to the bottom portions of the beams respectively and slidably engaged with the outer surface of the wall.

The retaining members each includes a projection extended upward therefrom and secured to the bottom portions of the beams respectively. The base includes an upper portion having a tapered surface formed thereon and facing away from the wall. The wall includes an upper portion having a flange extended laterally therefrom.

Two brackets are further secured on top of the posts, the guide rod includes two ends secured in the brackets and includes a groove formed in a bottom portion thereof, a rail is secured in the guide rod and includes a duct aligned with the groove of the guide rod.

The screen member includes a plurality of slides provided on the upper portion thereof and slidably engaged in the groove of the guide rod and the duct of the rail for allowing the panels to be folded and unfolded. The brackets each includes a key, the groove includes two ends engaged with the keys of the brackets for preventing the guide rod from rotating relative to the brackets.

Two sleeves are further engaged on the ends of the guide rod for engaging with the brackets and for allowing the guide rod to be secured to the brackets. The screen member includes a plurality of panels pivotally coupled together at a plurality of live hinges and having an upper portion slidably secured to the guide rod.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
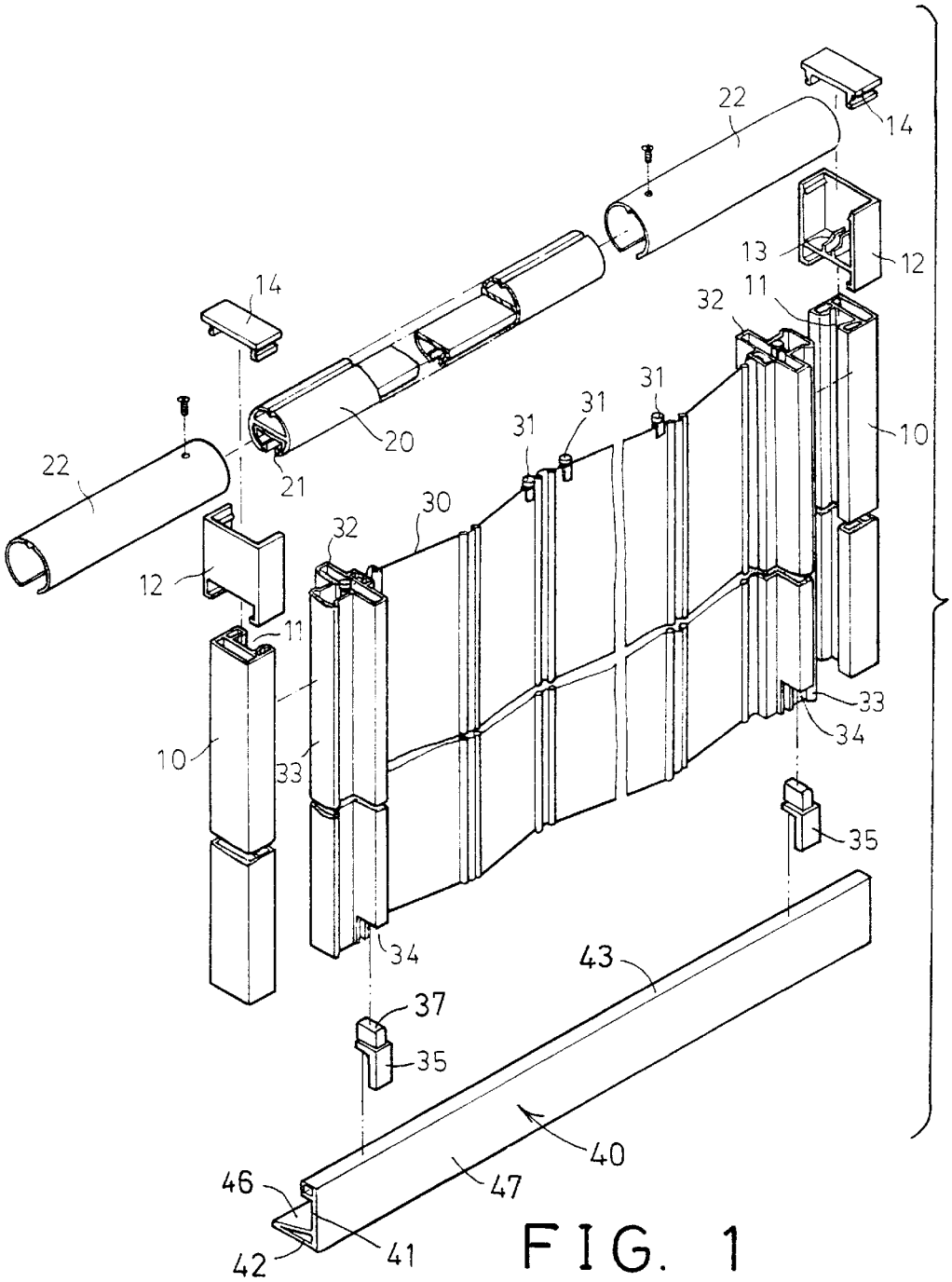
FIG. 1 is an exploded view of a shower screen in accordance with the present invention.

Referring to the drawings, a shower screen in accordance with the present invention comprises a pair of vertical posts 10 each including a longitudinal channel 11 formed therein and facing toward each other. Two brackets 12 are secured on top of the posts 10 respectively and each includes a key 13 provided therein. A guide rod 20 includes two ends engaged in the brackets 12 and includes a groove 21 formed in the bottom and having two ends engaged with the respective keys 13 for preventing the guide rod 20 from rotating relative to the brackets 12. Two caps 14 are secured on top of the brackets 12 for securing the guide rod 20 in place. Two sleeves 22 are engaged on the end portions of the guide rod 20 for engaging with the brackets 12 when the guide rod 20 is short, and for extending the length of the guide rod 20, such that the guide rod 20 of a shorter length may also be stably secured to the brackets 12. It is preferable that the rail 23 extends inward of the sleeves 22 (FIG. 4), for forming a solid structure.

Figure 2:
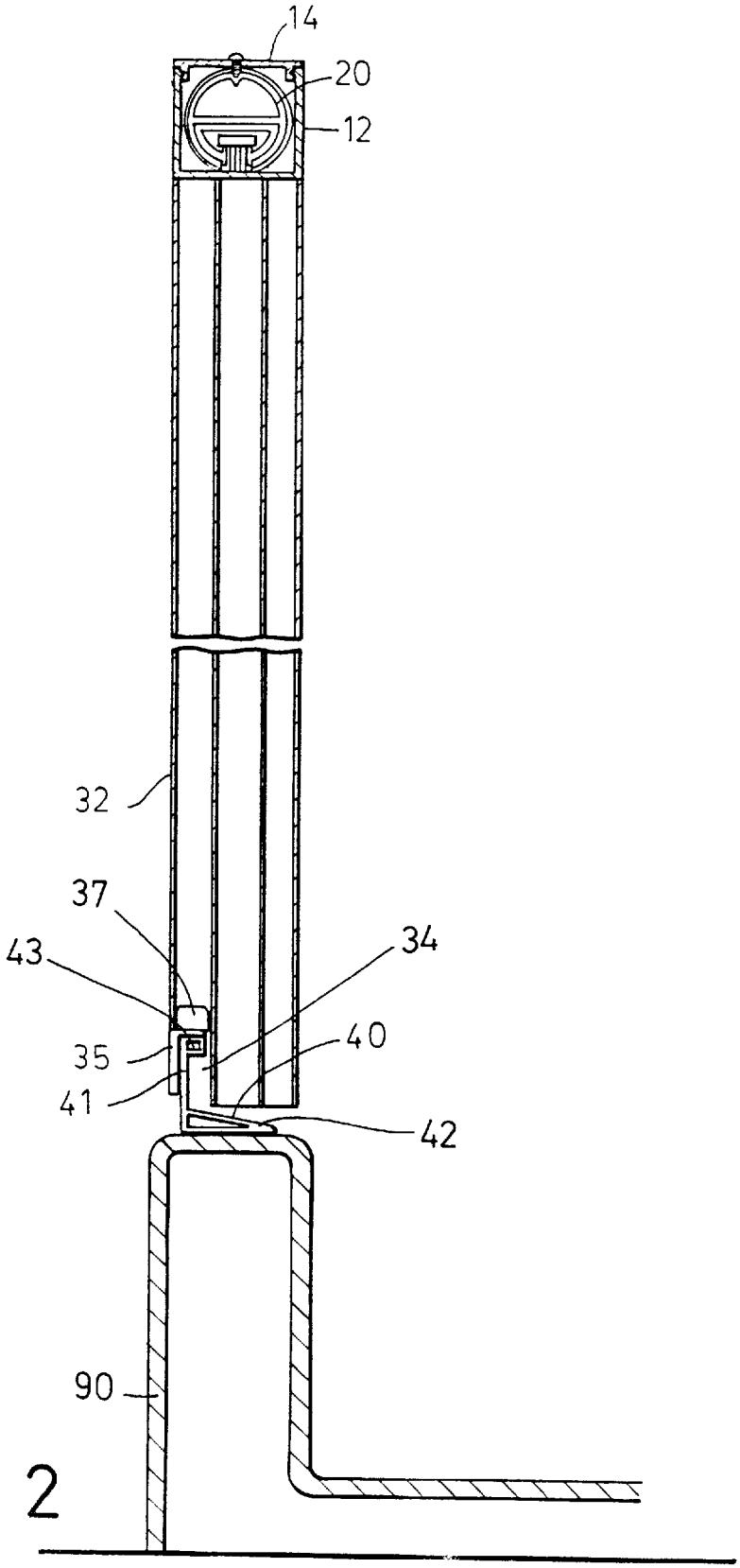
FIG. 2 is a lateral cross sectional view of the shower screen.

A screen member includes a number of foldable panels 30 each having a slide 31 provided on the upper portion thereof and slidably engaged in the groove 21 of the guide rod 20 for allowing the panels 30 to be folded and unfolded. Two beams 32 are secured to the side portions of the panels 30 and each includes a rib 33 for engaging into the channel 11 of the respective posts 10 and for forming a complete screen so as to prevent spilling while showering. A guide bar 40 is secured in the bottom portions of the posts 10 and has two ends secured to the posts 10 for forming a bottom block and guide member. The beams 32 each includes a notch 34 formed therein for engaging with the guide bar 40 and for preventing the beams 32 from moving outward beyond the bath tub 90 (FIG. 2). The panels 30 are pivotally secured together at a number of live hinges for allowing the panels 30 to be folded relative to each other and for forming a perfect screen. The ribs 33 of the beams 32 may be engaged into the channels 11 of the posts 10 so as to form a perfect water proof screen. In addition, the sleeves 22 allow the top guide rod 20 to be secured to the brackets 12 when the guide rod 20 is short. The above described structure is disclosed in U.S. Pat. No. 5,822,810 which is taken as a reference for the present invention. Instead of the panels 30, a screen member of cloth materials may also be secured between the beams 32 and slidably secured to the guide rod 20 by slides 31.

The guide bar 40 includes a wall 41 extended upward from a base 42 and includes a flange 43 extended laterally from the top portion of the wall 41 and extended inward of the bath tub 90, such that the size of the guide bar 40 may be reduced as compared with that of the applicant's prior U.S. Pat. No. 5,822,810. The base 42 is secured on top of the bath tub 90 and preferably includes a tapered surface 44 formed on the upper portion thereof and facing away from the wall 41 and facing inward of the bath tub 90 for guiding the water inward of the bath tub 90. One or two retaining members 35 are further provided and each includes a projection 37 extended upward therefrom for engaging into the respective beams 32 and for securing to the beams 32 by such as a force-fitted engagement or by adhesive materials or by the other fasteners. The retaining member(s) 35 are engaged with the outer surface 47 of the guide bar 40 for slidably securing the beams 32 to the guide bar 40 and for guiding the beams 32 to move along the guide bar 40 and for preventing the beams 32 from being separated from the guide bar 40.

Accordingly, the shower screen in accordance with the present invention includes a stably structure for preventing water spilling and for stably and slidably securing the panels to the guide rod and the guide bar and for stably securing the bottom portion of the beams of the shower screen to the lower guide bar.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shower screen comprising: a pair of vertical posts each including a longitudinal channel formed therein and each including a bottom portion, a guide rod secured on top of said posts, a screen member including an upper portion slidably secured to said guide rod for allowing said screen member to be folded and unfolded, said screen member including two side portions, a beam secured to each of said side portions of said screen member and each including a rib for engaging with said channel of said post for preventing spilling, a guide bar including two ends secured to said bottom portions of said posts for forming a bottom block and guide member, and means for slidably securing said beams to said guide bar and to guide said beams to slide along said guide bar, wherein said means for slideably securing said beams to said guide bar comprises a pair of downwardly proiecting retaining members, with said retaining members connected one each to an opening in a bottom portion of said beams and spaced apart from forming a pair of apertures defined by opening parallel surfaces of said retaining members and said beams, with said guide bar projecting into said apertures.

2. A shower screen according to claim 1, wherein said beams each includes a notch formed therein and defining one parallel side of said aperture for engaging with said guide bar and for preventing said beams from moving beyond said guide bar.

3. A shower screen according to claim 1, wherein said guide bar includes a base and a wail extended upward from said base, said wall includes an outer surface.

4. A shower screen according to claim 3, wherein said two retaining members secured to said bottom portions of said beams respectively and slidably engage with said outer surface of said wall.

5. A shower screen according to claim 4, wherein said retaining members each includes a projection extended upward therefrom and secured in said opening in said bottom portions of said beams respectively.

6. A shower screen according to claim 3, wherein said base includes an upper portion having a tapered surface formed thereon and facing away from said wall.

7. A shower screen according to claim 3, wherein said wall includes an upper portion having a flange extended laterally therefrom.

8. A shower screen according to claim 1 further comprising two brackets secured on top of said posts, said guide rod having two ends secured in said brackets and having a groove formed in a bottom portion thereof, a rail secured in said guide rod and having a duct aligned with said groove of said guide rod.

9. A shower screen according to claim 8, wherein said screen member includes a plurality of slides provided on said upper portion thereof and slidably engaged in said groove of said guide rod and said duct of said rail for allowing said panels to be folded and unfolded.

10. A shower screen according to claim 8, wherein said brackets each includes a key, said groove includes two ends engaged with said keys of said brackets for preventing said guide rod from rotating relative to said brackets.

11. A shower screen according to claim 8 further comprising two sleeves engaged on said ends of said guide rod for engaging with said brackets and for allowing said guide rod to be secured to said brackets.

12. A shower screen according to claim 1, wherein said screen member includes a plurality of panels pivotally coupled together at a plurality of live hinges and having an upper portion slidably secured to said guide rod.

* * * * *